US007694377B2

(12) United States Patent
Bourrelly

(10) Patent No.: US 7,694,377 B2
(45) Date of Patent: Apr. 13, 2010

(54) DEVICE FOR CLEANING A SMOOTH-WALLED TUBE

(75) Inventor: Bernard Bourrelly, Lesigny (FR)

(73) Assignee: R. Marchal & Cie, Montrreuil Sous Bois (FR)

( * ) Notice: Subject to any disclaimer, the term of this patent is extended or adjusted under 35 U.S.C. 154(b) by 1250 days.

(21) Appl. No.: 10/543,707

(22) PCT Filed: Feb. 9, 2004

(86) PCT No.: PCT/FR2004/000288

§ 371 (c)(1),
(2), (4) Date: Jul. 28, 2005

(87) PCT Pub. No.: WO2004/071682

PCT Pub. Date: Aug. 26, 2004

(65) Prior Publication Data

US 2006/0130251 A1 Jun. 22, 2006

(30) Foreign Application Priority Data

Feb. 10, 2003 (FR) ..... 03 01526

(51) Int. Cl.
*B08B 9/027* (2006.01)

(52) U.S. Cl. ..... 15/104.095; 15/104.09

(58) Field of Classification Search ..... 15/104.09, 15/104.095, 104.096, 104.12
See application file for complete search history.

(56) References Cited

U.S. PATENT DOCUMENTS 1,965,128 A * 7/1934 Miller ..... 15/104.09
1,978,853 A * 10/1934 Albright ..... 15/104.09

(Continued)

FOREIGN PATENT DOCUMENTS

FR 2 802 451 12/2000

*Primary Examiner*—Laura C Guidotti
(74) *Attorney, Agent, or Firm*—Sutherland Asbill & Brennan, LLP

(57) ABSTRACT

The invention relates to a device for cleaning a cylindrical or conical tube (2) having a smooth wall and placed in a horizontal or an inclined position, said device comprising: a cylindrical body (4) that has an axis X, that is suitable for being inserted axially into said tube, and that, around its periphery, has brush means (6, 7) for brushing the inside wall (1) of said tube (2); a rod (30) fastened to an end face of said body (4); and means for causing said rod (30) and said body (4) to turn about the axis X; said device being characterized by the fact that the cylindrical body (4) has a chamber (12) that is suitable for receiving a cleaning liquid and, on one of its generator lines, it has: a first orifice (14) opening out into a first end of a radial duct (17) which is disposed in said chamber (12) and whose second end (19) is disposed in the vicinity of that wall (20) of said chamber (12) which is situated facing said first orifice (14); and at least one second orifice (13, 15) open to the outside and serving to discharge a quantity of cleaning liquid by gravity when it is situated under the level (21) of the liquid in the chamber (12) while said device is turning; the first orifice (14) serving to fill said chamber (12) with cleaning liquid, and to allow air to be taken into said chamber (12) when the second end (19) of the duct (17) is disposed above the level (21) of the liquid.

12 Claims, 7 Drawing Sheets

U.S. PATENT DOCUMENTS 2,367,900 A 1/1945 Stine ..... 15/104.2
4,858,360 A 8/1989 Hardin ..... 42/95
2004/0025906 A1 * 2/2004 Bourrelly et al. ..... 134/8

* cited by examiner

DEVICE FOR CLEANING A SMOOTH-WALLED TUBE

TECHNICAL FIELD

The invention relates to a device for cleaning a cylindrical or conical tube having a smooth wall and placed in a horizontal or an inclined position.

BACKGROUND OF THE INVENTION

Cleaning and protecting gun tubes is necessary and such maintenance must be performed in the field, under severe climatic conditions.

A gun tube or a "gun barrel" has a "core" portion that can be provided with helical grooves, and a "chamber" portion that is smooth and conical to some extent, that is of a diameter greater than the diameter of the core portion, and that can be as long as 1 meter in length.

FR 2 802 451 relates to a device for cleaning the core portion of a tube whose inside periphery is rifled.

The present invention relates to a device for cleaning the chamber portion of a tube.

The chamber portion is cleaned and protected from oxidation with special oils. Brushes are used that are conical to some extent and whose bristles are generally implanted on supports made of wood or of a plastics material. The brush is inserted manually into the tube by means of a rod screwed to said brush. At its other end, the rod has a transverse peg forming a lever and making it possible to push and to pull the brush while turning it.

During a maintenance operation, the tube is in a position in which it is inclined relative to the horizontal and, preferably, with the end of the core portion inclined towards the ground, the orifice of the chamber at the other end then being higher.

Initially, brushing takes place while spreading a cleaning liquid that impregnates the residue left stuck to the walls after shells are fired. This makes it possible to wipe off the residue by means of a rag wrapped around the brush. A further quantity of cleaning liquid is then applied for providing protection from oxidation.

Such oily cleaning liquids are poured onto the brush prior to insertion into the chamber, or else they are sprayed on by means of an aerosol at the inlet of the chamber. However, access to the inlet of the chamber is difficult due to the presence of a cradle-shaped piece placed in front of said inlet.

The quantity of liquid used is therefore random, and it is difficult to spread it properly.

Depending on the skill of the person assigned to that task, it can happen that more oil is used than is necessary for achieving the desired objective.

SUMMARY OF THE INVENTION

An object of the invention is to provide a cleaning device that makes it possible to keep down consumption of the cleaning liquid, and to spread the liquid over the entire length in question simply and practically, and that facilitates the work of the person assigned to the cleaning task.

To this end, the invention provides a device for cleaning a cylindrical or conical tube having a smooth wall and placed in a horizontal or an inclined position, said device comprising: a cylindrical body that has an axis X, that is suitable for being inserted axially into said tube, and that, around its periphery, has brush means for brushing the inside wall of said tube; a rod fastened to an end face of said body; and means for causing said rod and said body to turn about the axis X.

This device is characterized by the fact that the cylindrical body has a chamber that is suitable for receiving a cleaning liquid and, on one of its generator lines, it has: a first orifice opening out into a first end of a radial duct which is disposed in said chamber and whose second end is disposed in the vicinity of that wall of said chamber which is situated facing said first orifice; and at least one second orifice open to the outside and serving to discharge a determined quantity of cleaning liquid by gravity when it is situated under the level of the liquid in the chamber while said device is turning; the first orifice serving to fill said chamber with cleaning liquid, and to allow air to be taken into said chamber when the second end of the duct is disposed above the level of the liquid.

Thus, the device proposed makes it possible to fill the chamber of the body with the quantity of liquid necessary for cleaning. So long as the orifices are positioned above the level of liquid, no discharge takes place.

Conversely, when the second orifices are below the level of the liquid, liquid is discharged, the duct then serving to transfer air to the chamber.

The brush is inserted into the tube to be cleaned with the generator line on which the orifices are disposed being situated in the top zone. In order to clean the inside wall of the tube, the brush is caused to turn about its axis, while causing it to move forwards and backwards axially as desired, as is current practice.

As the brush turns, the second orifices find themselves below the level of liquid for a fraction of a turn of the brush, and the higher the level of liquid, the greater that fraction is, the level being high in particular at the beginning of the cleaning operation.

The following advantageous provisions are also preferably used.

The chamber is constituted by a cylindrical cavity placed on the axis of the body and communicates with the outside via two second orifices disposed on either side of the first orifice and close to the axial ends of said chamber. This provision makes it possible to ensure that all of the liquid is discharged after a certain lapse of time, when the tube is inclined.

The second orifices are equipped with bleeds that are interchangeable, making it possible to adjust the liquid flow rate.

The chamber may be filled by means of a syringe having an outlet that fits into the flared inlet of the duct.

The brush means comprise a plurality of axial spatulas hinged to the body at their ends opposite from the rod and whose other ends are urged radially outwards by resilient means. This provision makes it possible to ensure that the conical walls are brushed.

The rod is fastened to the body by means of a device that enables an indicator visible on the rod to be aligned with the angular position of the generator line of the body on which the orifices are disposed. This provision enables the operator to identify the position of the orifices.

The means for fastening the rod comprise a tapped sleeve fastened to the corresponding end of the rod, said sleeve having a circular base received in an axial cavity provided in the end of the body and a radial flange having circularly arcuate slots serving to pass locking screws.

At its end remote from the body, the rod has two radially opposite pegs serving as handles.

The handles also serve to enable the operator to turn the brush, and to move it axially.

According to another advantageous characteristic of the invention, the handles extend from a casing mounted on that end of the rod which is remote from the body, said casing receiving a reciprocating pneumatic actuator for turning the rod and the body about the axis X, said actuator being controlled by a push button provided on one of said handles.

The push button preferably acts on a 5/2 distributor valve biased by a spring, pushing the push button causing the rod and the body to turn in one direction, and releasing said push button causing the rod and the body to return in the reverse direction towards the initial position.

In which case, when the rod is made up of two telescopic rod portions that are prevented from moving in rotation relative to each other, said two rod portions being prevented from moving axially by means of at least one pneumatic actuator. Said second actuator may be caused to move in one of the directions of rotation of the rod by its own push button or by the push button for controlling the reciprocating actuator.

Other advantages and characteristics of the invention will appear on reading the following description given by way of example and with reference to the accompanying drawings, in which:

These and other features of the present invention will become apparent to one of ordinary skill in the art upon review of the following detailed description when taken in conjunction with the drawings and the appended claims.

DETAILED DESCRIPTION OF THE INVENTION

Figure 1:
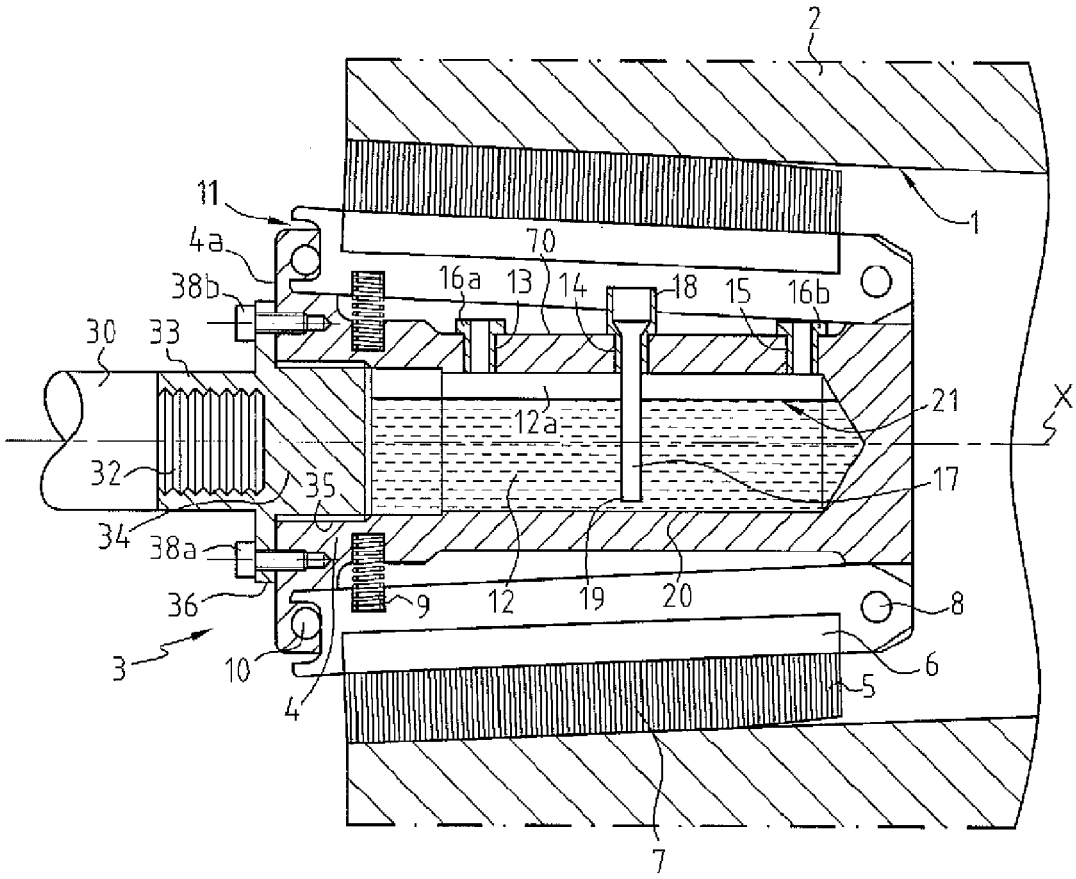
FIG. 1 is a section view on a plane containing the axis X of the brush of a cleaning device of the invention, disposed in a conical portion of a tube to be cleaned.

In the drawings, reference 1 is used to designate a substantially conical inside wall of a tube 2, and reference 3 is used to designate a brush for cleaning the inside wall 1.

The brush 3 essentially comprises a cylindrical body 4 of axis X that has a plurality of brush elements 5 around its periphery that are implemented in the form of spatulas 6 distributed uniformly about the axis, and extending in planes containing the axis X. The spatulas 6 are equipped with radial bristles 7. The spatulas 6 are pivotally mounted at one end of the body 4, by means of pins 8 that are perpendicular to the plane of each spatula 6, and they are mounted at the other of the body 4 in a manner such that they can move away outwards under drive from a spring 9, the extent to which they can move being limited by a pin 10 that is secured to the body and that is disposed in a radial notch 11 provided in the end of the spatula 6. This configuration enables the bristles 7 of each spatula 6 to be pressed against the conical inside wall 1 to be cleaned.

The diameter of the body 4 is determined such that the bristles 7 of the spatulas 6 can clean the conical wall 1 over the entire length thereof by means of the brush 3 moving axially.

In the invention, the body 4 is hollow and has a cylindrical internal reservoir 12 of axis X that communicates with the outside, as can be seen clearly in FIG. 1, via three orifices, referenced respectively 13, 14, and 15, which are disposed on the same generator line 70 of the body 4.

The end orifices 13 and 15 open out into reservoir 12 in the vicinities of the end walls that are perpendicular to the axis X of said reservoir 12, while the orifice 14 is disposed substantially halfway between the orifices 13 and 15.

The end orifices 13 and 15 are preferably tapped so as to enable bleeds 16*a* and 16*b* to be fastened, which bleeds are in the form of screws provided with holes through their centers. It is easy to replace the bleeds 16*a* and 16*b* with other bleeds having holes of different diameters in order to adjust the discharge flow rate of a liquid contained in the reservoir 12 as a function of its fluidity.

The central orifice 14, which can also be tapped, serves for fastening a duct 17 which, outside the body 4, has a flared inlet 18, and which extends radially through the reservoir 12 in a manner such that the other end 19 of said duct 17 is in the vicinity of the zone 20 of the inside wall of said reservoir 12 that is situated facing the central orifice 14.

The duct 17 makes it possible to fill the reservoir 12 with cleaning liquid by means of a syringe, for example, said syringe having a liquid outlet member which fits into the flared inlet 18.

While the reservoir 12 is being filled, the axis X of the brush 3 is disposed horizontally, and all three in-line orifices 13, 14, 15 are disposed in the top zone of the brush 3. The air contained in the reservoir is removed via the bleeds 16*a* and 16*b* as the filling progresses.

It is easy to understand that, when the brush 3 is caused to turn about its axis X which is disposed substantially horizontally, a time will come when the outlet orifices of the bleeds 16*a* and 16*b* find themselves below the level 21 of the liquid in the reservoir 12, thereby enabling a flow of liquid to be discharged towards the outside, the speed with which said time comes being a function of the level 21.

During the turning, the flared inlet 18 of the duct 17 also comes below the level 21, but, conversely, the end 19 of the duct 17 rises and comes to be positioned above the level 21, and the zone 12*a* of the reservoir 12 that is situated above the level 21 comes into communication with the outside via the duct 17, thereby putting said reservoir zone 12*a* at atmospheric pressure and facilitating the flow of liquid via the bleeds 16*a* and 16*b*.

Figure 5:
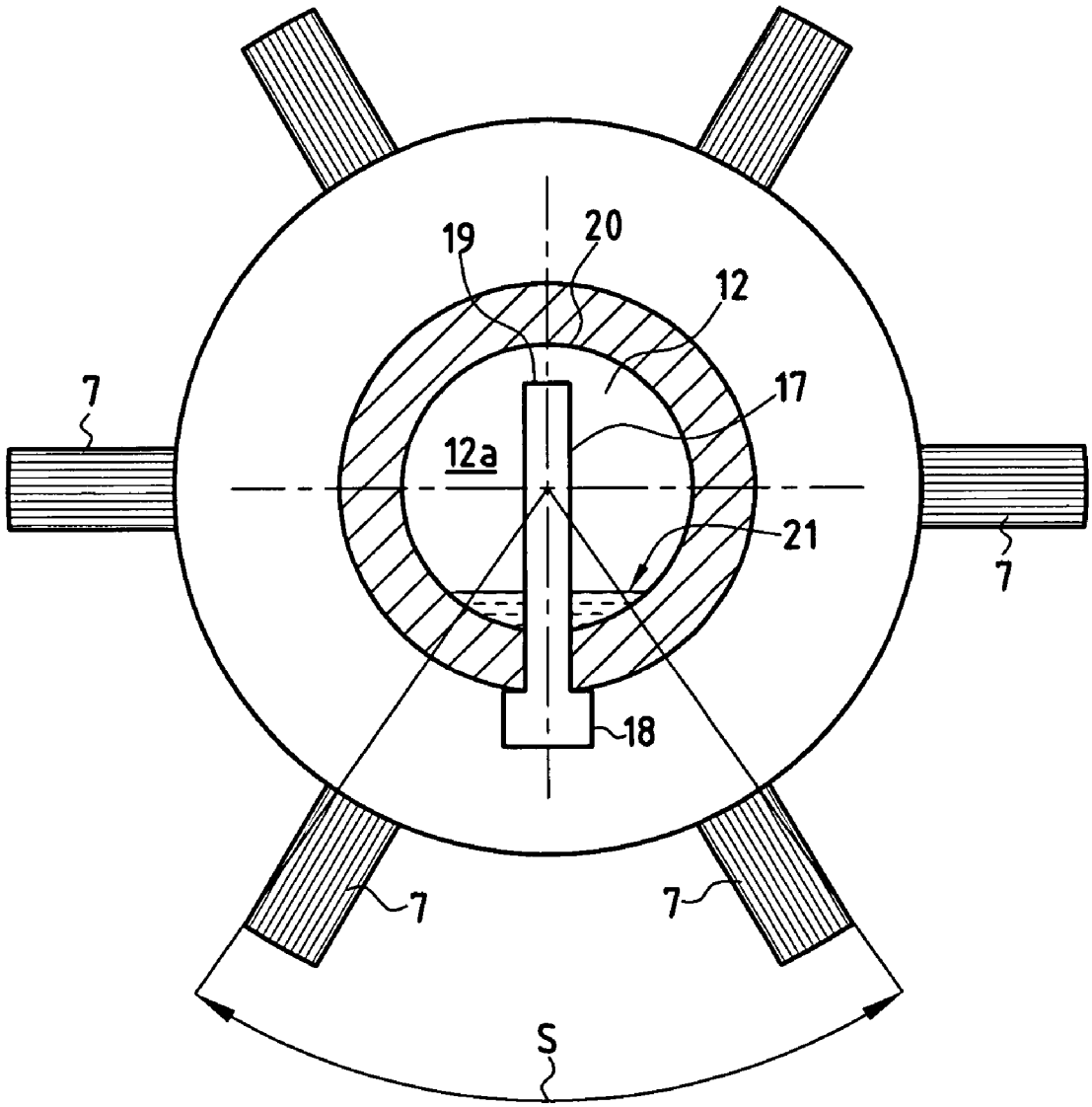
FIG. 5 shows a liquid discharge angular sector that is a function of the level of the liquid.

FIG. 5 shows the angular sector S within which one of the bleeds 16*a* and 16*b* must be disposed in order to enable cleaning fluid to be discharged. The higher the level of liquid 21 in the reservoir 12, the larger the sector S.

Figure 2:
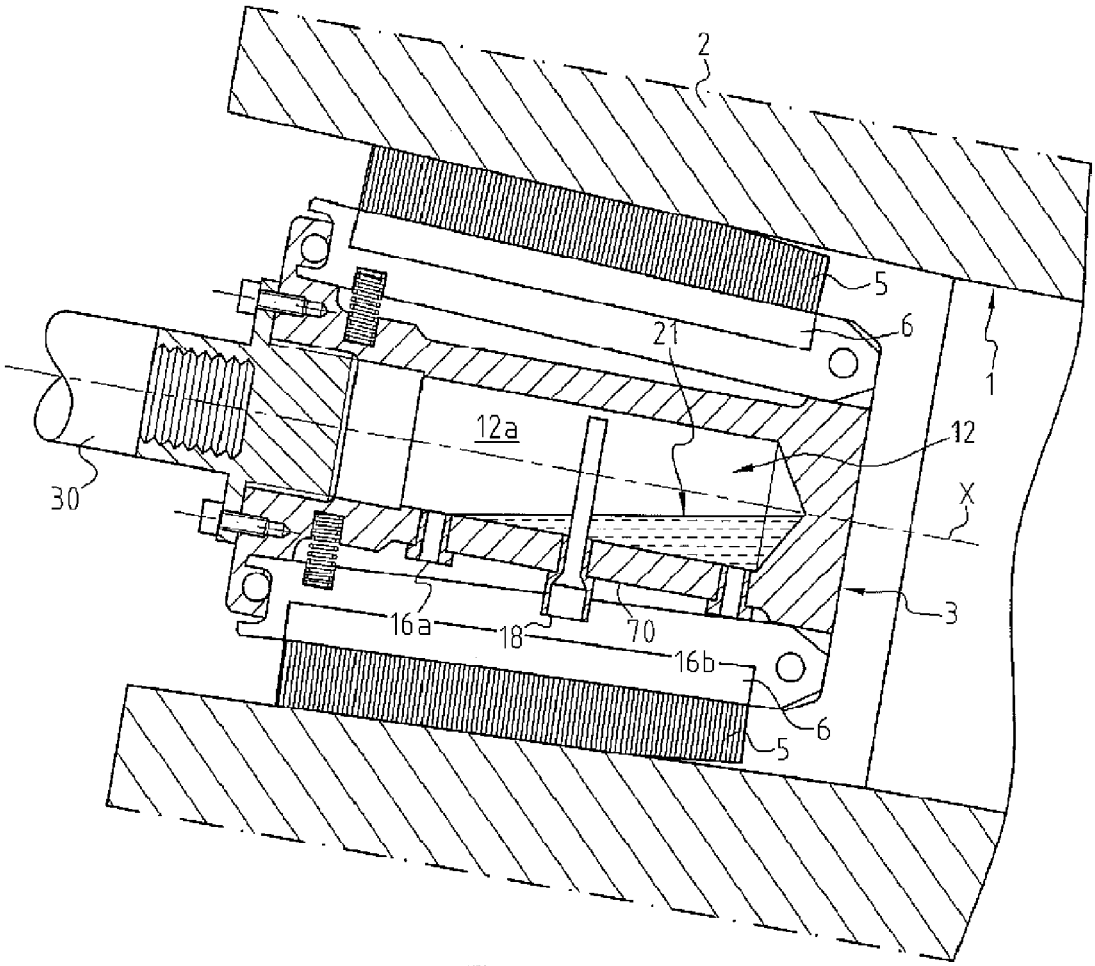
FIG. 2 shows the same device disposed in an inclined tube, with the device having been turned through one half-turn.

FIG. 2 shows the brush 3 disposed in an inclined tube 2, the reservoir 12 containing little liquid. In the example shown in FIG. 2, the bleed 16*a* always finds itself above the level 21, but the other bleed 16*b* makes it possible to discharge all of the liquid from the reservoir 12 when it finds itself vertically beneath the axis X.

The brush 3 is fastened to the end of a rod 30. As indicated above, the angular position of the generator line containing the orifices 13, 14, and 15 must be identified by the operator during the cleaning so that said operator knows whether the liquid can be discharged. This is why the rod 30 is provided with an indicator referenced 31 on FIG. 3 that indicates visually the angular positioning of the orifices 13, 14, and 15.

Figure 4:
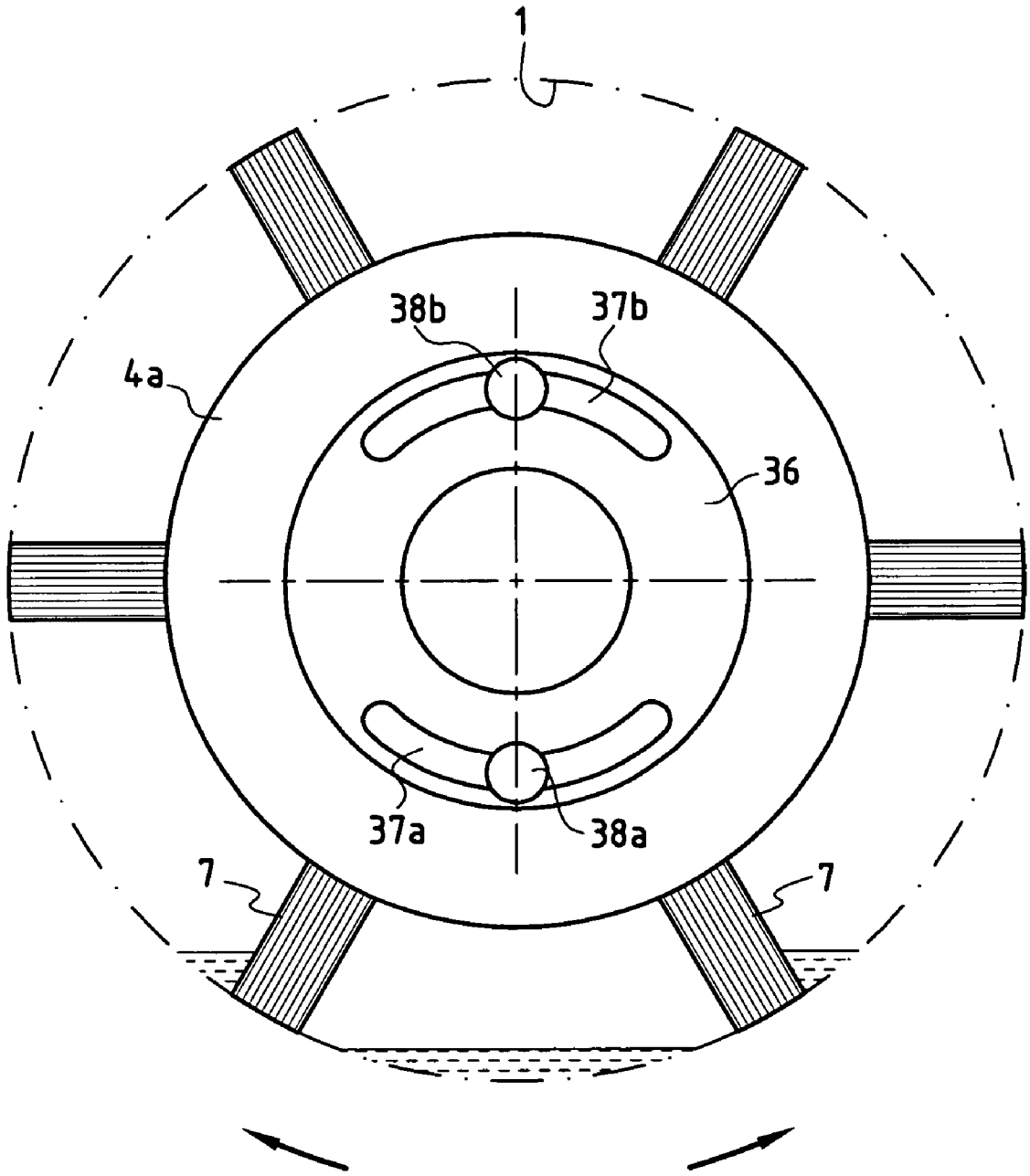
FIG. 4 is an end view of the brush, seen looking from the rod, showing the fastening means for fastening the rod to the brush.

As is shown in FIGS. 1 and 4, the rod 30 has a threaded end 32 which is received in the tapped cavity of a sleeve 33, one end 34 of which is rotatably received in a cylindrical cavity 35 of axis X that is provided in an end face 4*a* of the body 4. The sleeve 33 is further provided with a radial flange 36 that comes into abutment against the end face 4*a* of the body 4 and that has two opposite circularly arcuate slots 37*a* and 37*b* through which the shanks of respective ones of two locking screws 38*a* and 38*b* pass.

The circularly arcuate slots 37*a* and 37*b* make it possible to position the indicator 31 accurately in the plane containing the axis X and the orifices 13, 14, and 15.

At its end remote from the brush 3, the rod 30 is also provided with two pegs 40*a*, 40*b* that serve as handles and that extend from the rod 30 in opposite directions. The handles can serve as levers for manually turning the brush 3 about the axis X.

Figure 6:
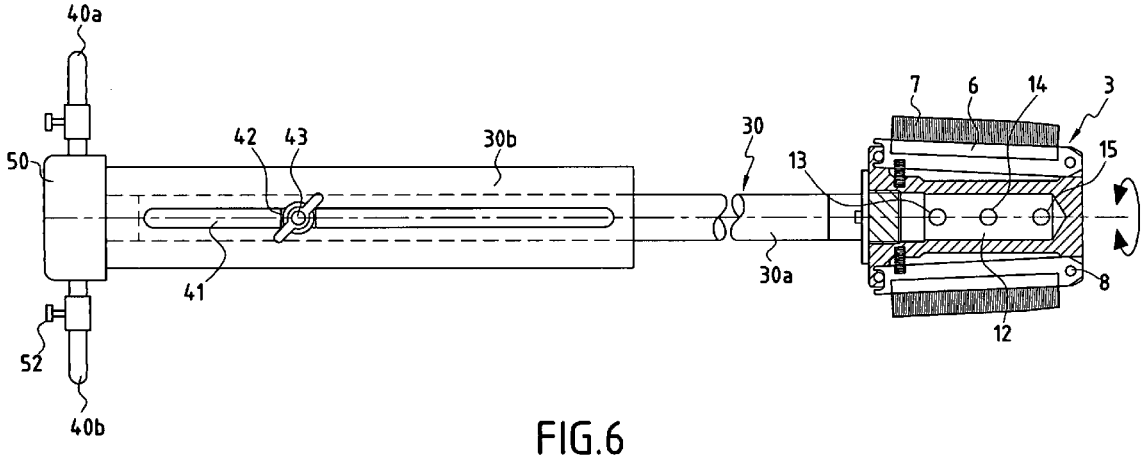
FIG. 6 is similar to FIG. 3, and it shows a rod made in two telescopic portions.

As shown in FIG. 6, the rod 30 can be made up of two rod portions 30*a* and 30*b* mounted to slide one in the other, the portion 30*b* being hollow and having an inside diameter slightly greater than the outside diameter of the portion 30*a* that is fastened to the body 4. The portion 30*b* is provided with a slot 41 parallel to the axis X that makes it possible to hold the portion 30*b* stationary relative to the portion 30*a* firstly in mutual rotation by means of a screw 43 passing through the slot 41 and fastened to the portion 30*a*, and secondly in axial translation by means of a nut 42 which co-operates with a thread on the screw 43.

This telescopic rod makes it easier to insert the brush 3 into the tube 2, and to adjust the length of the rod 30 as the brush 3 moves axially inside the tube 2. The slot 41 is preferably disposed in line with the orifices 13, 14, and 15, in which case it replaces the indicator 31 shown in FIG. 3.

Figure 3:
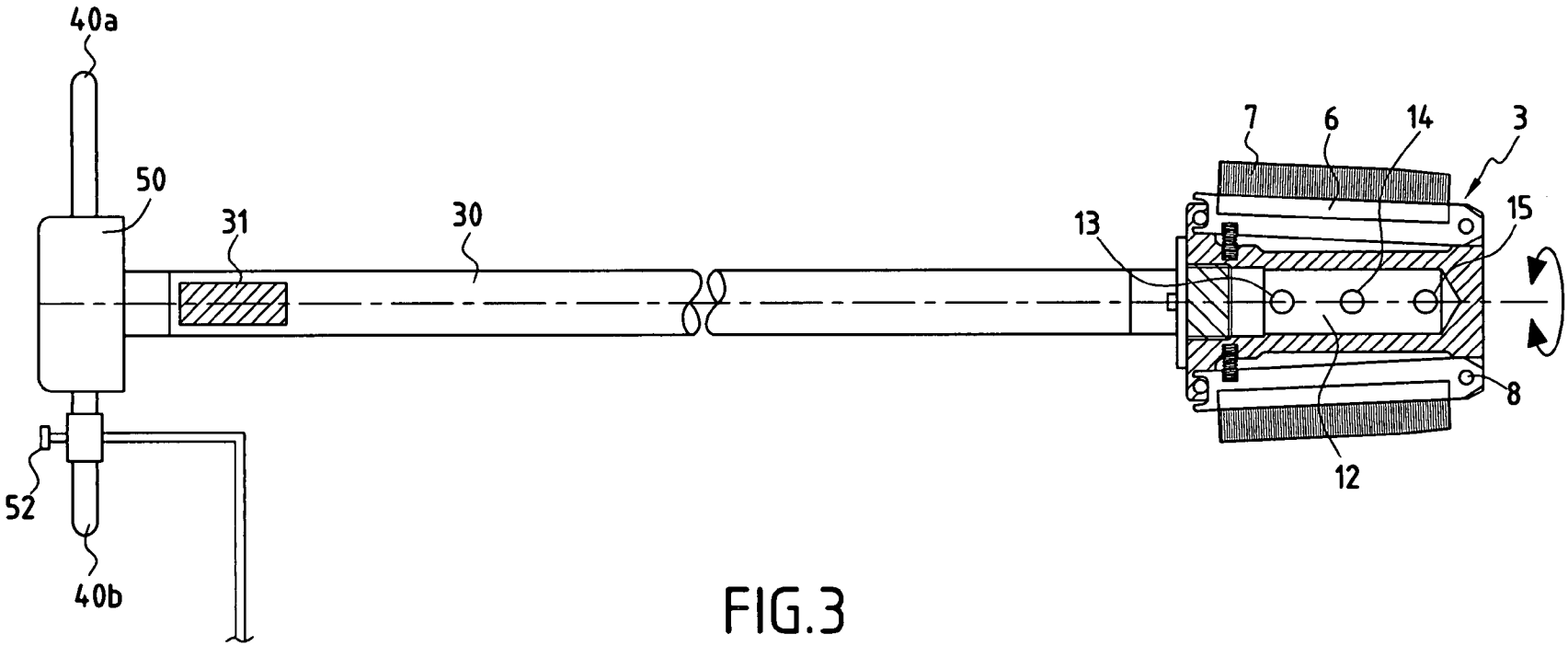
FIG. 3 is a view from above, showing the device on its own.

Very advantageously, and as shown in FIGS. 3 and 6, the handles 40*a* and 40*b* extend radially from a casing 50 disposed at the end of the rod 30 and containing a reciprocating actuator 51 fed with fluid under pressure, in particular compressed air, and enabling the rod 30 to be driven in rotation about its axis by actuating a push button 52 mounted on the handle 40*b*.

Figure 7:
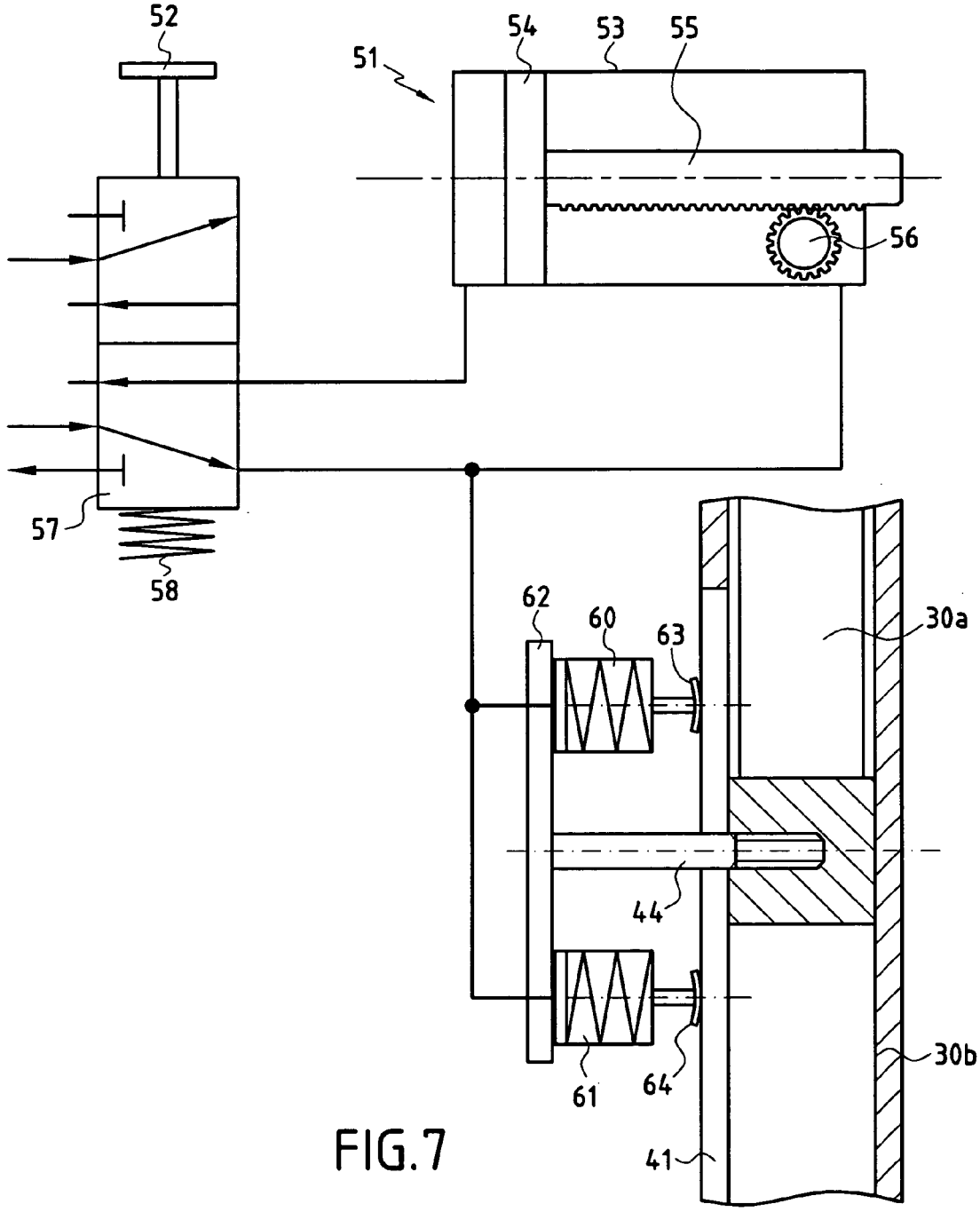
FIG. 7 shows a pneumatic system for causing the rod to turn and for locking the two portions thereof.

The reciprocating actuator 51, shown in detail in FIG. 7, has a cylinder 53 slidably receiving a piston 54 whose rod 55 constitutes a rack that drives in rotation a pinion 56 mounted on the end of the rod 30.

The push button 52 actuates a distributor valve 57 of the 5/2 type. One of the inlet ports is continuously in communication with a pressure source, and the other inlet port is in communication with a discharge.

The distributor valve 57 is biased by a spring 58 that urges the push button 52 outwards. When the operator pushes the push button 52, one face of the piston 54 is loaded by the compressed air and the other is in communication with a discharge, thereby moving the piston 54 in one direction, the rack 55 then causing the pinion 56 to turn. The dimensions of the rack 55 and of the pinion 56 are determined such that the rod 30 turns through an angle of at least 180° and preferably through an angle of 360°. When the operator releases the push button 52, the spring 58 returns the distributor valve 57 to its original position, thereby reversing the pressures on the two faces of the piston 54, and said piston moves in the reverse direction and returns to its initial position in which the orifices 13, 14, and 15 of the reservoir 12 are positioned above the axis X.

Advantageously, by means of flow rate limiters placed on the orifices of the actuator 51, it is possible to adjust the speed of rotation of the rod 30, and thus to obtain respective liquid discharge volumes for each rotation cycle.

By combining the speed of rotation with the diameter of the orifices of the bleeds 16*a* and 16*b*, it is possible to determine an optimum emptying curve for the reservoir 12 so as to spread the liquid over a length of tube to be treated.

When the rod 30 is made up of two telescopic rod portions 30*a*, 30*b*, the nut 42 can be replaced with two actuators 60 and 61 shown in FIG. 7 and actuated by means of a push button similar to the push button described above. For example, the actuators 60 and 61 bear against a plate 62 that is secured to the screw 44 and they exert pressure by means of shoes 63 and 64 on the outside surfaces of the rod portion 30*b* that are adjacent to the slot 41. Other configurations for installing the actuators 60 and 61 are naturally possible.

The two actuators 60 and 61 can be actuated by means of the push button 52 which causes the rod 30 to rotate. Thus, in one direction of rotation of the rod 30, the two rod portions 30*a* and 30*b* are held stationary axially by means of the shoes 63 and 64 and, in the reverse direction, the two rod portions 30*a* and 30*b* can move axially relative to each other. This enables the operator to adjust the length of the rod 30 before each treatment cycle.

Operation of the device of the invention is described below.

After the rod 30 has been fastened to the body 4 with the indicator 31 in line with the orifices 13, 14, and 15, the reservoir 12 is filled.

For this purpose, the assembly made up of the rod 30 and of the brush 3 is laid horizontally, with the orifices 13, 14, and 15 being disposed in the top zone of the brush 3, and the reservoir 12 is filled with a quantity of cleaning liquid, e.g. by means of a syringe, via the filling orifice 18.

After filling the reservoir 12, the brush 3 is inserted into the orifice of the tube 2, with the bleeds 16*a* and 16*b* in the top or "standby" position in which the liquid cannot be discharged.

The brush 3 is then turned by means of the handles 40*a* and 40*b* or by pushing the push button 52 if the rod 30 is driven by a reciprocating actuator 51. Each turn of the brush 3 causes the reservoir 12 to undergo a bleed cycle over a varying angular sector whose amplitude decreases as a function of the level 21 of liquid.

The liquid is discharged uniformly by gravity by means of the duct 27 which, by construction, simultaneously puts the top portion 12*a* of the reservoir 12 into communication with the atmosphere.

At the start of emptying, the discharge volume per cycle or turn is larger, since the reservoir 12 is full, because the discharge takes place over a sector S that is larger. This is advantageous because the bristles 7 of the spatulas 6 can thus be completely impregnated and can immediately spread the liquid over the inside wall 1 of the tube 2.

Any surplus liquid flows down with the slope of the tube and is taken up by the spatulas 6. At each cycle, or simultaneously, the brush 3 is moved axially inside the tube 2. The diameter of the orifices of the bleeds 16*a* and 16*b* is chosen as a function of the length of the tube 2 to be treated so that the determined quantity is discharged over the entire length to be treated.

It is desirable to reverse the direction of rotation when turning the brush 3. This is achieved automatically if the rod 30 is driven by a reciprocating actuator 51. Thus, the spatulas 6 entrain the liquid that is scraped off the inside wall 1 of the tube 2 and they entrain it in one direction and then in the other in alternation.

While the brush 3 is turning, the operator can use the handles 40*a*, 40*b* to move the brush 3 axially inside the tube 2.

It should be apparent that the foregoing relates only to the preferred embodiments of the present invention and that numerous changes and modifications may be made herein without departing from the spirit and scope of the invention as defined by the following claims and the equivalents thereof.

The invention claimed is:

1. A device for cleaning a cylindrical or conical tube having a smooth wall and placed in a horizontal or an inclined position, said device comprising: a cylindrical body that has an axis of revolution X and generator lines, that is suitable for being inserted axially into said tube, and that, around its periphery, has brush means for brushing the inside wall of said tube; a rod fastened to an end face of said body; and means for causing said rod and said body to turn about the axis of revolution X; wherein the cylindrical body has a chamber that is suitable for receiving a cleaning liquid, the chamber being closed with exception of a first orifice and at least a second orifice, the first orifice opening out into a first end of a radial duct having two ends which is disposed in said chamber, the second end of the radial duct being disposed in the vicinity of that wall of said chamber which is situated facing said first orifice; the second orifice opening to the outside; the first orifice and the second orifice being aligned along one of the generator lines of the body; the second orifice serving to discharge a quantity of cleaning liquid by gravity when the second orifice is situated under the level of the liquid in the chamber while said device is turning; the first orifice serving to fill said chamber with cleaning liquid, and to allow air to be taken into said chamber when the second end of the duct is disposed above the level of the liquid.

2. A device according to claim 1, wherein the chamber is constituted by a cylindrical cavity placed on the axis of revolution X of the body and communicates with the outside via two second orifices disposed on either side of the first orifice and close to the axial ends of said chamber.

3. A device according to claim 1, wherein the brush means comprise a plurality of axial spatulas hinged to the body at their ends opposite from the rod and whose other ends are urged radially outwards by resilient means.

4. A device according to claim 1, wherein the rod is fastened to the body by means of a device that enables an indicator visible on the rod to be aligned with the angular position of the generator line of the body on which the orifices are disposed.

5. A device according to claim 4, wherein the means for fastening the rod comprise a tapped sleeve fastened to the corresponding end of the rod, said sleeve having a circular base received in an axial cavity provided in the end of the body and a radial flange having circularly arcuate slots serving to pass locking screws.

6. A device according to claim 1, wherein, at its end remote from the body, the rod has two radially opposite pegs serving as handles.

7. A device according to claim 6, wherein the handles extend from a casing mounted on that end of the rod which is remote from the body, said casing receiving a reciprocating pneumatic actuator for turning the rod and the body about the axis of revolution X, said actuator being controlled by a push button provided on one of said handles.

8. A device according to claim 7, wherein the push button acts on a 5/2 distributor valve biased by a spring, pushing the push button causing the rod and the body to turn in one direction, and releasing said push button Causing the rod and the body to return in the reverse direction towards the initial position.

9. A device according to claim 7, wherein the rod is made up of two telescopic rod portions that are prevented from moving in rotation relative to each other, said two rod portions being prevented from moving axially by means of at least one pneumatic actuator.

10. A device according to claim 9, wherein the pneumatic actuator is caused to move in one of the directions of rotation of the rod by the push button for controlling the reciprocating actuator.

11. A device for cleaning a cylindrical or conical tube having a smooth wall and placed in a horizontal or an inclined position, said device comprising: a cylindrical body that has an axis X and generator lines, that is suitable for being inserted axially into said tube, and that, around its periphery, has brush means for brushing the inside wall of said tube; a rod fastened to an end face of said body; and means for causing said rod and said body to turn about the axis X; wherein the cylindrical body has a chamber that is suitable for receiving a cleaning liquid and, on one of its generator lines, it has: a first orifice opening out into a first end of a radial duct having two ends which is disposed in said chamber, the second end of the radial duct being disposed in the vicinity of that wall of said chamber which is situated facing said first orifice; and at least one second orifice open to the outside and serving to discharge a quantity of cleaning liquid by gravity when the second orifice is situated under the level of the liquid in the chamber while said device is turning; the first orifice serving to fill said chamber with cleaning liquid, and to allow air to be taken into said chamber when the second end of the duct is disposed above the level of the liquid, wherein the second orifices are equipped with bleeds that are interchangeable, making it possible to adjust the liquid flow rate.

12. A device for cleaning a cylindrical or conical tube having a smooth wall and placed in a horizontal or an inclined position, said device comprising: a cylindrical body that has an axis X and generator lines, that is suitable for being inserted axially into said tube, and that, around its periphery, has brush means for brushing the inside wall of said tube; a rod fastened to an end face of said body; and means for causing said rod and said body to turn about the axis X; wherein the cylindrical body has a chamber that is suitable for receiving a cleaning liquid and, on one of its generator lines, it has: a first orifice opening out into a first end of a radial duct having two ends which is disposed in said chamber, the second end of the radial duct being disposed in the vicinity of that wall of said chamber which is situated facing said first orifice; and at least one second orifice open to the outside and serving to discharge a quantity of cleaning liquid by gravity when the second orifice is situated under the level of the liquid in the chamber while said device is turning; the first orifice serving to fill said chamber with cleaning liquid, and to allow air to be taken into said chamber when the second end of the duct is disposed above the level of the liquid, wherein the duct has a flared inlet outside the first orifice in order to facilitate filling the chamber.

* * * * *